United States Patent [19]

Lees

[11] Patent Number: 4,770,495

[45] Date of Patent: Sep. 13, 1988

[54] TEMPORARY ROADWAY BARRIER OF CONTRASTING PANEL PORTIONS WITH REFLECTIVE RIDGES OR BEADS AT THE PANEL JUNCTIONS

[75] Inventor: Anthony Lees, Carleton, United Kingdom

[73] Assignee: Glasdon Limited, Blackpool, United Kingdom

[21] Appl. No.: 832,534

[22] Filed: Feb. 24, 1986

[30] Foreign Application Priority Data

Feb. 22, 1985 [GB] United Kingdom ..... 8504679

[51] Int. Cl.[4] ..... G02B 5/124; G02B 5/13; G02B 5/132; E01F 13/00

[52] U.S. Cl. ..... 350/103; 350/106; 350/107; 350/109; 404/6

[58] Field of Search ..... 350/102, 103, 104, 105, 350/106, 109, 100, 107, 108; 404/6, 14

[56] References Cited

U.S. PATENT DOCUMENTS

| | | | |
|---|---|---|---|
| 2,542,894 | 2/1951 | Blanchard | 350/97 |
| 3,802,378 | 4/1974 | Kessler | 350/97 |
| 3,905,680 | 9/1975 | Nagel | 350/103 |
| 3,989,351 | 11/1976 | Bjorlund | 350/102 |
| 4,182,548 | 1/1970 | Searight et al. | 350/103 |
| 4,236,788 | 12/1980 | Wyckoff | 350/106 |
| 4,312,600 | 1/1982 | Schaaf et al. | 404/6 |
| 4,383,782 | 5/1983 | Pillifant, Jr. | 404/6 |

FOREIGN PATENT DOCUMENTS

| | | | |
|---|---|---|---|
| 288337 | 5/1953 | Switzerland | 404/6 |
| 1531725 | 11/1978 | United Kingdom . | |
| 1531724 | 11/1978 | United Kingdom . | |

OTHER PUBLICATIONS

Brochure, "Chapter 8 Reflective/Dayglo Scarecrow Pendant Hazard Barrier", Glasdon Limited.

Brochure, "Scarecrow New Multicolor Reflective Hazard Barrier", Glasdon Limited.

*Primary Examiner*—John K. Corbin

*Assistant Examiner*—Ronald M. Kachmarik

*Attorney, Agent, or Firm*—Roylance, Abrams, Berdo & Goodman

[57] ABSTRACT

The disclosures relates to a barrier plank for a roadway having spaced triangular section ridges extending across the plank at spaced locations along the length of the plank. Each ridge provides a facet facing at an acute angle to the plank in one direction and a corresponding facet on the other side of the ridge facing at an acute angle along the plank in the opposite direction. Facets have red retro-reflective surfaces and facets have white retro-reflective surfaces. Thus light directed from a vehicle at a shallow angle onto the barrier plank will be reflected back by the facets according to the direction of approach so the plank will be readily visible to the driver. Between the ridges the plank has alternate red and white reflective surfaces to reflect back light directed at normal or near normal angles to the plank.

9 Claims, 3 Drawing Sheets

TEMPORARY ROADWAY BARRIER OF CONTRASTING PANEL PORTIONS WITH REFLECTIVE RIDGES OR BEADS AT THE PANEL JUNCTIONS

BACKGROUND OF THE INVENTION

1. Field of the Invention

This invention relates to barriers for temporary roadway or pavement barrier systems.

2. Prior Art

U.K. Patent Specification Nos. 1531724 and 1531725 describes temporary roadway or pavement barrier systems in which spaced free standing posts have horizontally extending barrier planks suspended between them. The planks have highly reflective surfaces of alternately coloured patches or areas (e.g. red and white) along the planks to enhance the visibility of the planks. Nevertheless the planks do not have a high degree of visibility particularly at night time when illuminated, for example, by the light beams of a motor vehicle which are incident on the barrier planks at an acute angle thereto.

SUMMARY OF THE INVENTION

The invention provides an elongate barrier for a temporary roadway or pavement free standing barrier system, the barrier being of elongate rectangular form and having means to suspend the barrier from a pair of free standing posts, the barrier having one surface consisting of alternate portions of contrasting colours to render the barrier readily visible to incident light from in front or nearly in front of the barrier and retro-reflective means on the barrier facing along and/or at an acute angle to the lengthwise direction of the barrier in at least one direction along the barrier to reflect light incident from the source lying obliquely to the barrier directed back towards the source to enhance the visibility of the barrier from an oblique direction such as a passing vehicle at night time.

A plurality of said light retro-reflective means may be provided at spaced locations along the barrier.

Preferably the surface of the barrier is also provided with one or more further light retro-reflective means facing at an acute angle to the opposite lengthwise direction of the barrier.

The light retro-reflective means angled to one lengthwise direction of the barrier may be differently coloured from the light retro-reflective means angled to the opposite lengthwise direction of the barrier.

For example the first mentioned light retro-reflective means may be coloured red and the further light retro-reflective means are coloured white so that the barrier can be arranged at the road side to reflect a red light back to near side-traffic and a white light back to off-side traffic.

The or each light retro-reflective means may comprise a raised facet extending down the surface of the barrier and facing at an acute angle to the lengthwise direction of the barrier.

One or more triangular section ridges are formed on the plank and extending down the barrier, the face on one side of the ridge providing a facet angled to one lengthwise direction of the barrier and the facet on the other side of the ridge providing the retro-reflective means angled to the other lengthwise direction of the barrier.

A plurality of said raised ridges may be provided at spaced locations along the length of the plank and the angle of the apex of the or each ridge may be 30 degrees.

In an alternative construction, the reflection means may comprise a plurality of reflection beads mounted at spaced locations along the barrier and facing lengthwise of the barrier.

In any of the above arrangements the plank surface may be light retro-reflective surfaces between the light retro-reflective means.

In the latter case the light retro-reflective surfaces may be alternately coloured red and white along the length of the plank.

DESCRIPTION OF THE PREFERRED EMBODIMENTS

Figure 1:
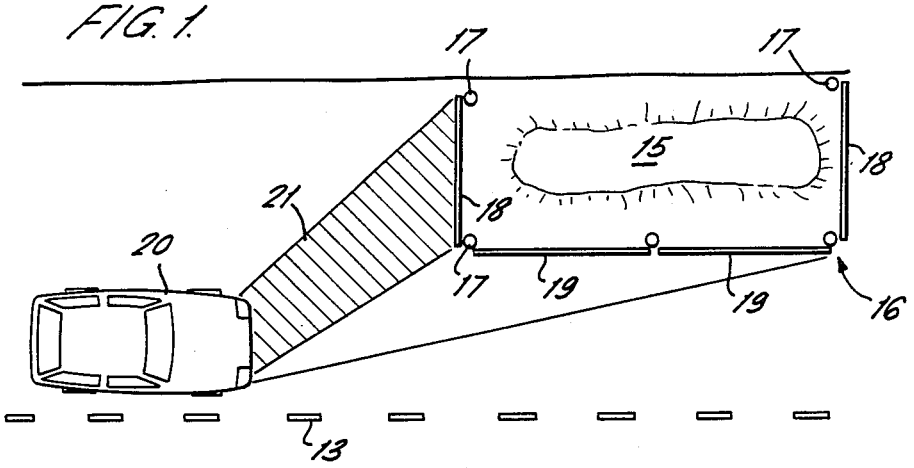
FIG. 1 is a plan view of part of a roadway showing a temporary barrier system installed around the site of a roadworks.

Referring firstly to FIG. 1 of the drawings; there is shown a roadway indicated generally at 10 and comprising a carriageway 11 bounded by a pavement or embankment indicated at 12. A centre line of the carriageway is indicated at 13. A roadworks site is formed in the carriage way 11 at 15 adjacent the pavement and is partly encircled by a barrier system indicated at 16. The barrier system comprises free standing upright posts 17 disposed around the perimeter of the roadwork site and the barriers 18 formed by planks are slung between the posts at the ends of the site and further barrier planks 19 are slung between the posts along the side of the site extending along the carriageway.

The barrier planks 18 are extruded plastic mouldings having light retro-reflective surfaces which may be "chequered" comprising alternate red and white areas. Such light retro-reflection surfaces are capable of retro-reflecting back along the same path of light incident up to about 45 degrees to the normal.

Figure 2:
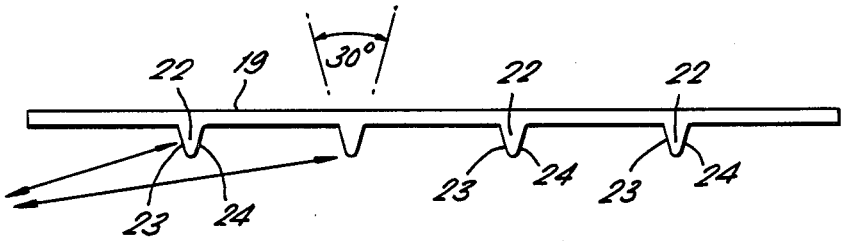
FIG. 2 is a plan view of one of the planks of the temporary barrier system.
Figure 3:
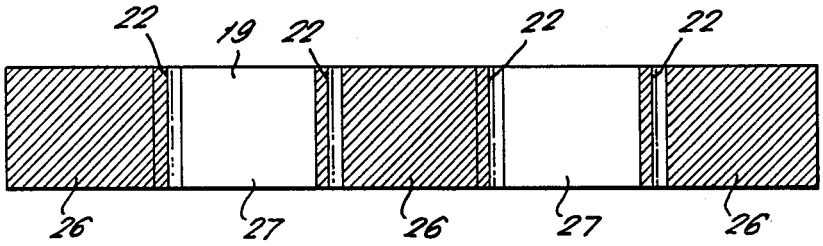
FIG. 3 is an elevation view of the plank.

A vehicle is indicated at 20 on the carriageway 11 approaching the site of the roadworks 15 at night time and a light beam from the vehicle headlamps is indicated generally at 21. At least a proportion of the light incident on the end plank 18 will be reflected back towards the vehicle so that the plank is clearly illuminated by the vehicle lights. In order that light from the vehicle lamps is reflected back from the more obliquely angled side barrier planks 19 to render them readily visible to the vehicle driver, the planks 19 are constructed in accordance with the invention as will now be described with reference to FIGS. 2 and 3.

Each plank 19 is formed with four raised triangular section ridges 22 equally spaced along the length of the plank and each extending down the full depth of the plank. The apex angle of each ridge is 30 degrees. Each ridge provides one facet 23 facing outwardly from the surface of the plank at an acute angle to one lengthwise direction of the plank and a similar facet 24 facing outwardly of the surface of the plank at an acute angle to the opposite lengthwise direction of the plank. The facets 23 have red retro-reflective surfaces and the facets 24 have white retro-reflective surfaces. The planks 19 are mounted with their red retro-reflective surfaces directed towards the near side oncoming traffic so that light falling obliquely on the planks 19 from a vehicle position as shown in FIG. 1 illuminates the retro-reflective facets 23 to render the planks readily visible to the driver. The white retro-reflective surfaces 24 face towards approaching off-side traffic on the other side of the carriageway to reflect white light back to off-side approaching traffic. The separate areas of the plank delineated by the ridges 23 have alternately red 26 and white 27 retro-reflective surfaces to reflect back the light incident at or around the normal to the plank.

Thus the driver of a vehicle approaching the barrrier system on his nearside from a shallow angle will see a series of red retro-reflective bars illuminated by his lights which may merge into a single retro-reflective block at a very shallow angle approach but will otherwise be separated by blank spaces where the angle is too shallow for the normal surface of the plank to reflect back light.

It will be understood that the particular colouring of the retro-reflective surfaces of the planks is not restricted to red and white and other colours or colour combinations may be used in keeping with general road marking conventions.

Figure 4:
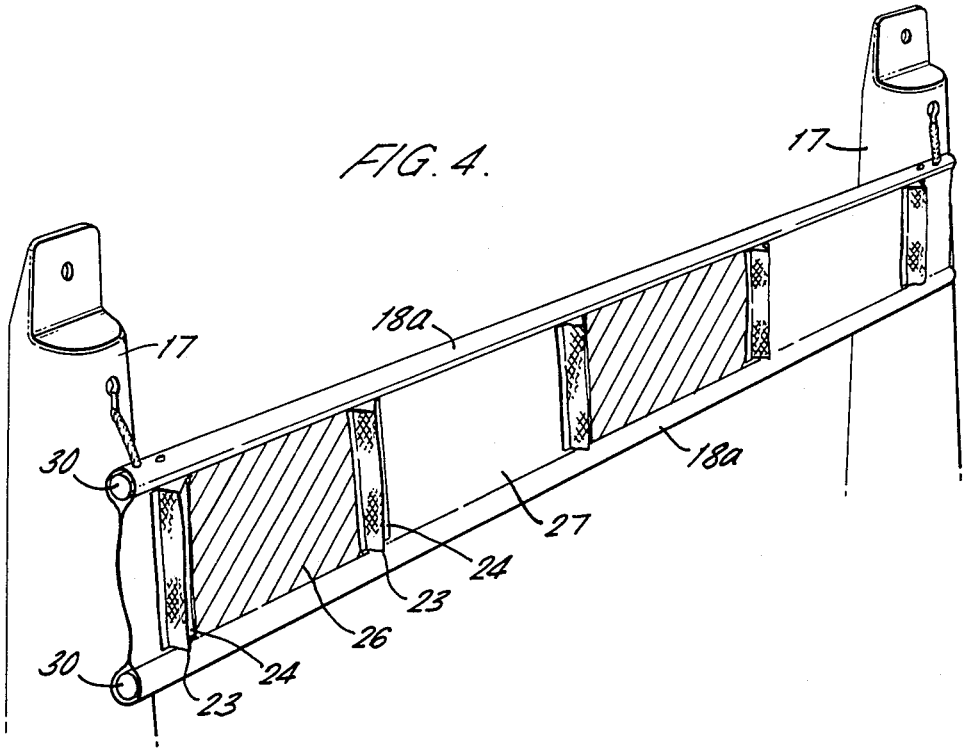
FIGS. 4 to 8 illustrate further barrier construction.

Reference is now made to FIGS. 4 to 8 of the drawings which show alternative forms of barrier embodying the invention. Referring firstly to FIG. 4 of the drawings, there is shown a flexible barrier plank 18 produced from a strip of PVC coated fabric having a hem 18*a* along each edge of the strip in which tubes 30 of metal or plastics are inserted to stiffen the strip and cause it to act in much the same way as a rigid plank when suspended by the top reinforcing tube on a pair of upright posts 17 of the barrier system. The retro-reflective ridges 23 are provided by pockets or folded strips 31 attached to the main strip of the barrier.

Figure 5:
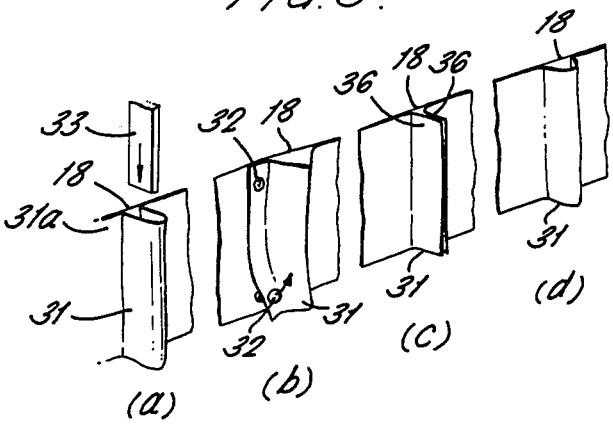

FIG. 5 illustrates four different ways designated a, b, c, and d in which the retro-reflective ridges are formed. In each case a folded strip or strips of material having a retro-reflective surface is applied to the backing. In the arrangement of FIG. 5*a* a single strip is folded to form a narrow pocket 31 with out-turned flaps 31*a* which are heat sealed to the main strip of the plank. The pocket may be stiffened by an insert 33. With the inserts 33 and tubes 30 removed the plank can conveniently be rolled up into a compact size when not in use. In FIG. 5*b* the pockets 31 are attached by "press-studs" 32 to the main wall of the plank. In the arrangement of FIGS. 5*c*, two upturned flaps 36 secured to the barrier strip 18 are secured together face-to-face to form the ridge 23 and in FIG. 5*d* the ridge is formed by a simple folded strip welded to the barrier and pre-folded to provide the generally triangular cross-section illustrated. The outer sides of the facets of the pockets as formed facing in one direction along the plank have red retro-reflective surface 23 and the facets of the pockets facing in the opposite direction along the barrier plank have white retro-reflective surfaces 24. The arrangement is otherwise generally similar to that described with reference to FIGS. 1 to 4 above.

Figure 6:
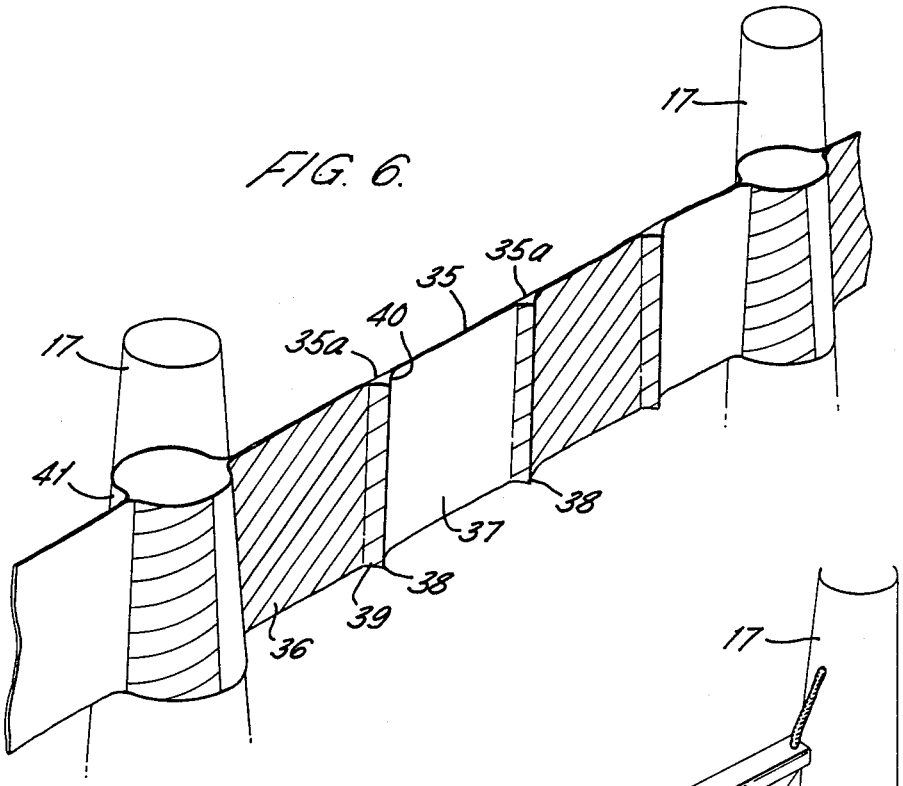

FIG. 6 of the drawing shows the further arrangement in which a broad web of flexible material 35 is covered with alternate red and white patches 36, 37 which are retro-reflective to light. At the junctions between contrasting patches along the web, the web is gathered into ridges 38 extending across the web by means of a second web 35*a* attached to the reverse side of the main web. The ridges provide facets 39 and 40 facing at acute angles in both directions along the barrier to reflect back light incident on the barrier at an acute angle thereto. At spaced locations along the barrier the main web 35 and its backing 35*a* are formed to provide in addition enlarged pockets 41 to receive the upper ends of barrier posts 17 to support the barrier on the posts.

Figure 7:
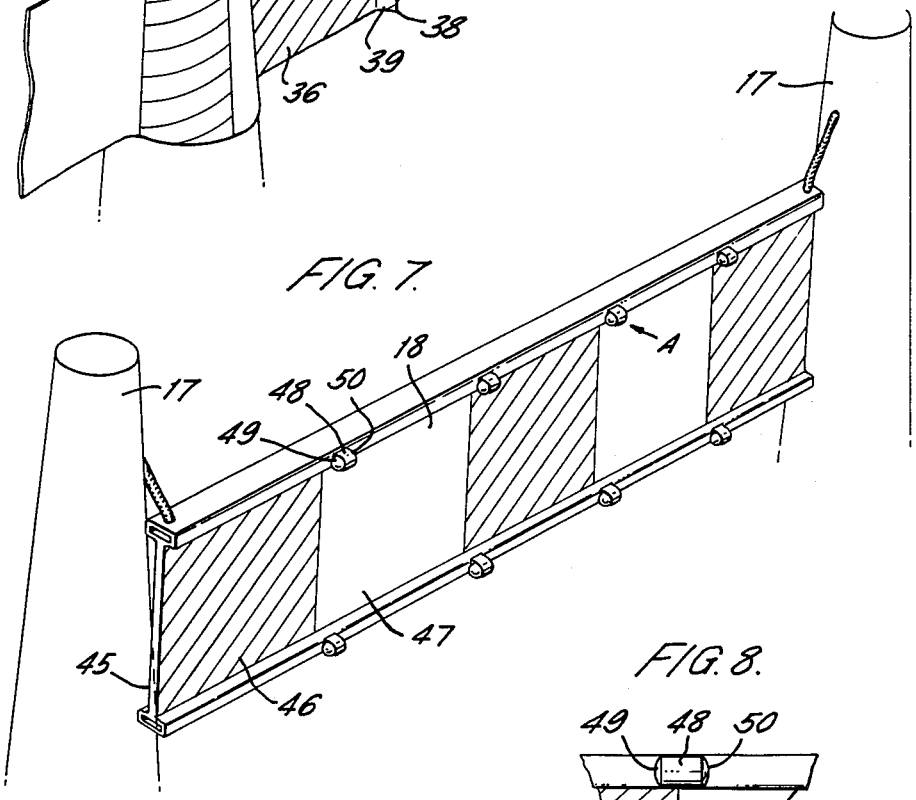
Figure 8:
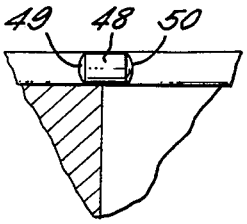

FIGS. 7 and 8 of the drawings show yet a further construction of barrier plank 18. In this case the plank is of I-section with the main web 45 of the plank being provided with alternate areas along the web of contrasting red and white or red and yellow patches 45, 47. Injection moulded plastics housing 48 are attached along the sides of the head and base of I-section adjacent each junction between a pair of contrasting patches on the web of the section. Each housing 48 contains a pair of glass bead reflectors 49, 50 mounted in housing and facing in one or other direction along the plank to reflect back light incident on the plank at an acute angle thereto in a similar manner to that of the previously described embodiments. The reflectors 49 are coloured red and the reflectors 50 are coloured white so that the barrier can be arranged with the red reflectors facing towards nearside traffic passing the barrier and with the white reflectors facing offside traffic passing the barrier.

I claim:

1. A barrier for a temporary free standing barrier system on a roadway or pavement, comprising:

an elongate barrier member of rectangular form;

coupling means, on said barrier member, for supporting said barrier member on a pair of independent free standing posts;

the barrier member having one side face formed with panel portions spaced along the side face, said panel portions having alternate contrasting reflective colors with junctions between adjacent panel portions, whereby said side face is readily visible when illuminated by light from in front of the face; and triangular section ridges extending across said side face of the barrier member at the junctions between said contrasting reflective panel portions, each ridge having light retro-reflective facets on either side thereof facing in opposite directions at narrow angles to a lengthwise direction of the elongate barrier member respectively to retro-reflect light incident on the facets at narrow angles to the barrier member to render the barrier member readily visible when illuminated and viewed along or at narrow angles thereto.

2. A barrier according to claim 1, wherein said retro-reflective facets facing in one direction along the barrier member are differently colored from retro-reflective facets facing in the opposite direction.

3. A barrier according to claim 2 wherein said light retro-reflective facets facing in said one direction are colored red; and said light retro-reflective facets facing in the opposite direct are colored white so that the barrier member can be arranged at a road side to reflect a red light back to near-side traffic and a white light back to off-side traffic.

4. A barrier to claim 3 wherein an angle of an apex of each ridge is about 30 degrees.

5. A barrier according to claim 1 wherein the reflective color portions between said ridges are alternately colored red and white along the length of the barrier member.

6. A barrier for a temporary free standing barrier system on a roadway or pavement, comprising:

an elongate barrier member of rectangular form;

coupling means, on said barrier member, for supporting said barrier member on a pair of independent free standing posts;

the barrier member having one side face formed with panel portions spaced along the side face, the panel portions having alternate constrasting reflective colors with junctions between adjacent panel portions, whereby said side face is readily visible when illuminated by light from in front of the face; and a plurality of retro-reflective beads mounted at said spaced junctions along the side face of the barrier member between the contrasting colored panel portions and facing in both directions along the barrier member to retro-reflect light incident on the beads along or at a narrow angle to the lengthwise direction of the barrier member to render the barrier member readily visible when illuminated and viewed along or at narrow angles thereto.

7. A barrier according to claim 6 wherein said retro-reflective beads are mounted along at least one longitudinal edge of the barrier member.

8. A barrier according to claim 6 wherein the reflective beads facing in one direction along the barrier member have a contrasting color to the reflective beads facing in the opposite direction along the barrier member.

9. A barrier according to claim 8 wherein the beads facing in said one direction are colored red and the beads facing in the opposite direction are colored white.

* * * * *